United States Patent [19]

Jägerstrom

[11] 3,973,747

[45] Aug. 10, 1976

[54] METHOD OF AND ARRANGEMENT FOR CONTROLLING THE SPEED OF THE MOVEMENTS OF HYDRAULIC BOOMS

[75] Inventor: Axel Henry Jägerstrom, Tyreso, Sweden

[73] Assignee: Atlas Copco Aktiebolag, Nacka, Sweden

[22] Filed: Oct. 18, 1974

[21] Appl. No.: 515,845

[30] Foreign Application Priority Data

Oct. 24, 1973 Sweden ..... 7314399

[52] U.S. Cl. ..... 248/16; 173/43

[51] Int. Cl.[2] ..... E21C 5/11; E21C 9/00; E21C 11/00

[58] Field of Search ..... 248/16, 2; 137/625.48; 173/43; 91/420, 449, 444, 447, 420

[56] References Cited

UNITED STATES PATENTS

| | | | |
|---|---|---|---|
| 2,940,263 | 6/1960 | Cudnohvesky | 91/447 X |
| 3,164,065 | 1/1965 | Frantz | 91/449 X |
| 3,253,613 | 5/1966 | Richolt | 137/625.48 X |
| 3,273,468 | 9/1966 | Allen | 91/420 |
| 3,363,514 | 1/1968 | Ramcke | 91/449 X |
| 3,426,799 | 2/1969 | Kintner | 137/625.48 |
| 3,481,409 | 12/1969 | Westerlund | 173/43 |
| 3,523,490 | 8/1970 | Bianchetta | 91/420 |
| 3,558,102 | 1/1971 | Cruse | 91/447 X |
| 3,700,396 | 10/1972 | Adams | 91/449 |
| 3,851,566 | 12/1974 | Herrman | 91/444 X |

*Primary Examiner*—J. Franklin Foss
*Attorney, Agent, or Firm*—Flynn & Frishauf

[57] ABSTRACT

A method of and arrangement for controlling the speed of the movements of hydraulic booms and of members attached thereto, wherein the movements are performed by hydraulic motors and the return flow from the motors is throttled in one or more steps for adjusting the speed in a stepwise manner. The invention may to advantage be used for controlling the movements of a supporting member for a rock drilling machine, such as a boom or a feed bar, whereby the supporting member is moved by a pressure fluid actuated cylinder and the return flow from the cylinder is throttled in the above manner.

15 Claims, 7 Drawing Figures

34-38
41
39
40

29
28
2
30
27
j
i
h
25
g
26
f
e
d
23
c
22
b
a
24
l
k
21
15
16
14
12
17
38
37
36
35
34

METHOD OF AND ARRANGEMENT FOR CONTROLLING THE SPEED OF THE MOVEMENTS OF HYDRAULIC BOOMS

This invention relates to a method of and an arrangement for controlling the speed of the movements of hydraulic booms and of members attached thereto, wherein the movements are preformed by hydraulic motors.

Manually actuated directional control valves of the mobile type are usually used for controlling the movements of booms. Such valves, however, have in most cases unsatisfactory inching capabilities and require great operating forces.

It is an object of the present invention to provide an improved control of the movements of booms in these respects. Another object of the invention is to attain a good inching with an exceedingly small contribution from auxiliary equipment.

SUMMARY OF THE INVENTION

According to one aspect of the present invention there is provided a method of controlling the speed of the movements of a hydraulic boom which is pivotally arranged with respect to a support, carries a working implement, and is of the type wherein the movements of the boom are performed by at least one hydraulic motor, and the return flow from said cylinder is conducted to low pressure, the method comprising selectively ramifying the return flow into one of at least two branches, and providing flow restriction in at least one of said branches, for adjusting the speed in steps of predetermined sizes.

According to another aspect of the invention there is provided an improved hydraulic boom arrangement comprising a boom which is pivotally arranged with respect to a support, the boom carrying a working implement, at least one hydraulic motor connected to said boom for swinging the boom, a pressure fluid source, means for supplying pressure fluid to said motors, and means for conducting the return flow from said at least one motor to a tank via a conduit, the improvement comprising a valve connected in said conduit the conduit having, at least two branches between said valve and said tank, fluid restriction means connected in at least one of said at least two branches, and means adapted to set said valve for selectively conducting said return flow through either one of said at least two branches.

The above and other purposes of the invention will become apparent from the following description and from the accompanying drawings in which one embodiment of the invention is illustrated by way of example. It should be understood that this embodiment is only illustrative of the invention and that various modifications thereof may be made within the scope of the claims following hereinafter.

DETAILED DESCRIPTION OF ILLUSTRATED EMBODIMENT

Figure 1:
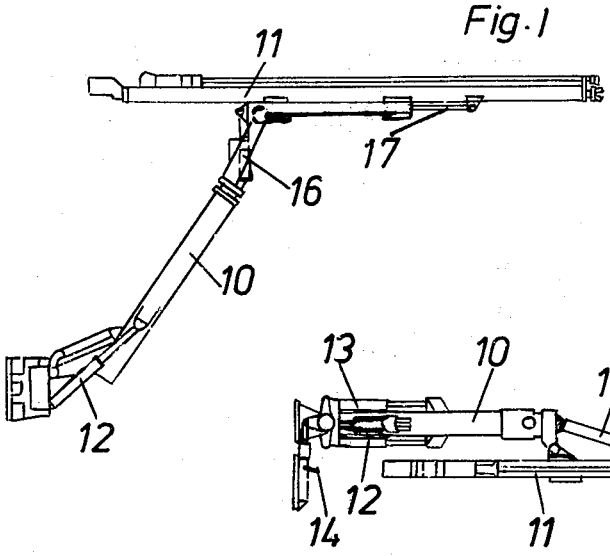
FIG. 1 shows a side view of a drill boom and a feed bar of a rock drilling machine, where the speed of the pistons in the shown cylinders is regulated according to the invention.
Figure 2:
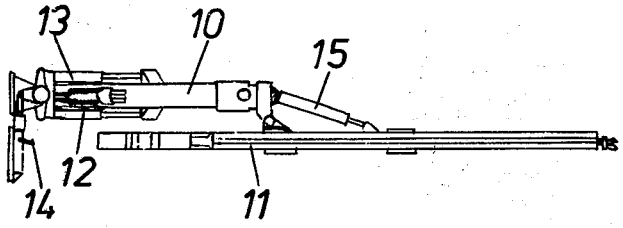
FIG. 2 is a top view of the drill boom of FIG. 1.

In FIGS. 1 and 2, the drill boom 10 is elevated and lowered by means of hydraulic cylinders 12, 13 and is swung laterally by means of a hydraulic cylinder 14. A rock drilling apparatus mounted on the outer end of the boom 10 is tilted by means of a hydraulic cylinder 16 and is swung by means of a hydraulic cylinder 15. A hydraulic cylinder 17 is provided for the displacement of the rock drilling apparatus. The rock drilling apparatus comprises a feed bar 11 and a rock drilling machine mechanically fed therealong.

Figures 3, 4:
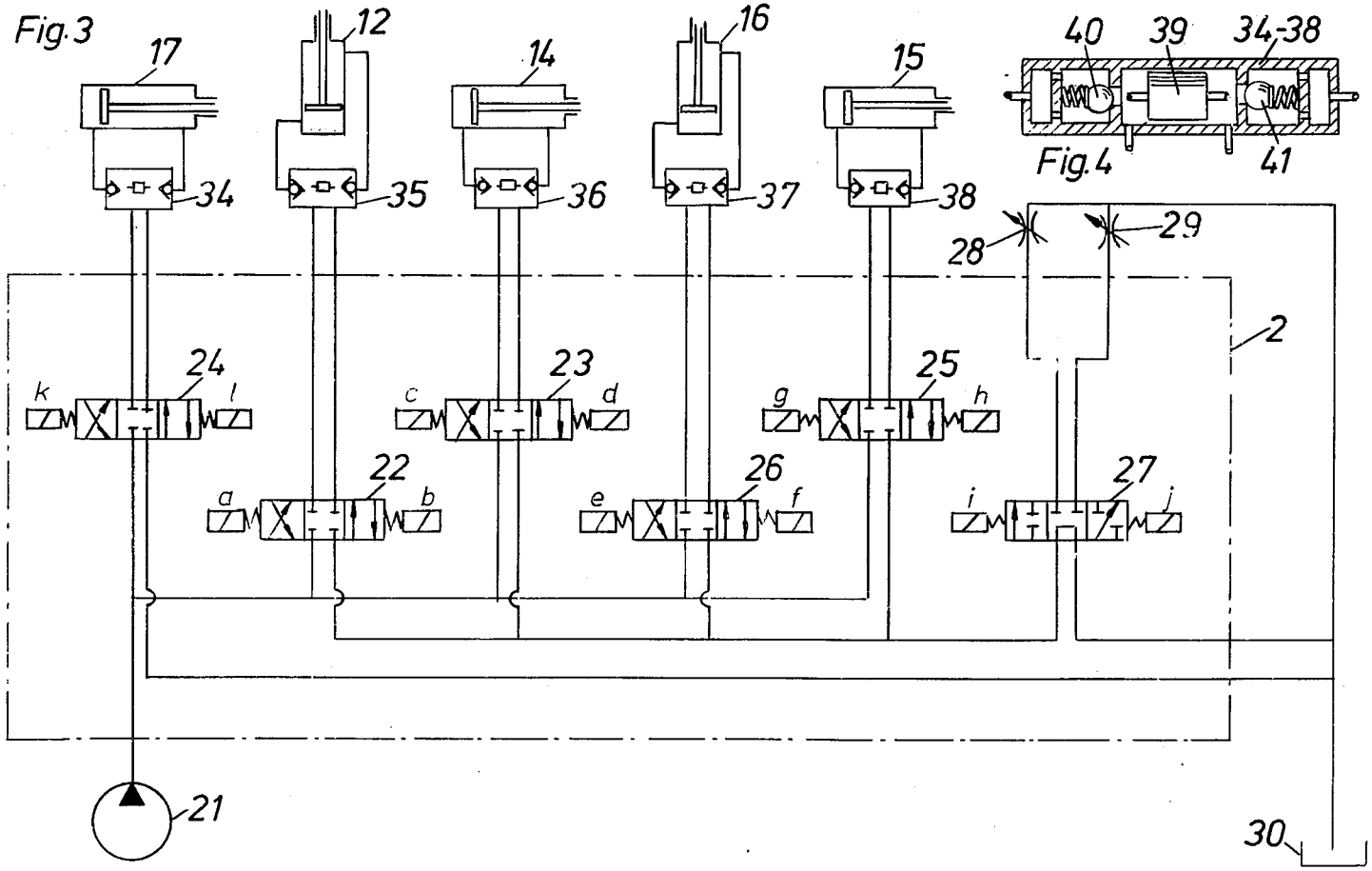
FIG. 3 diagrammatically shows the hydraulic circuitry of the cylinders in FIGS. 1 and 2.
FIG. 4 shows in a longitudinal section a conventional hydraulic lock for a cylinder included in the hydraulic circuitry of FIG. 3.

As may be seen in the hydraulic coupling circuitry shown in FIG. 3 a remote controlled, directional control valve 22 is connected between a pump 21 and the cylinder 12. Valves 23, 24, 25 and 26 respectively of the same sort are connected between the pump 21 and the respective cylinders 14, 17, 15 and 16. In conventional manner, respective hydraulic locks 34–38 are connected to each of the cylinders to lock the pistons when the valves are unactuated. A valve 27 is connected in the conduits of the return flow from the cylinders 12, 14, 15 and 16. Two restrictions 28, 29 are connected in separate conduits between the outlet of said valve 27 and the tank 30, the one restriction 28 having a smaller area and the other 29 having a larger area. The valves 22–27 are shown mounted in a block 2.

As may be seen in the circuitry in FIG. 3, each of the hydraulic cylinders 12, 14, 15, 16 and 17 respectively is provided with a conventional hydraulic lock respectively 34, 35, 36, 37 and 38. As shown in FIG. 4, the hydraulic locks are provided with a reversing piston 39 which cooperates with a pair of check valves 40, 41.

Figure 5:
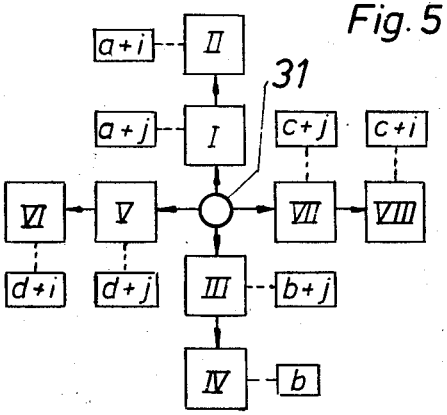
FIGS. 5, 6 and 7 respectively show the moving pattern of the operating means placed on an operator's panel, which operating means are intended for controlling respectively the elevating and swinging of the drill boom, the tilting and swinging of the feed bar and the displacement of the feed bar.
Figure 6:
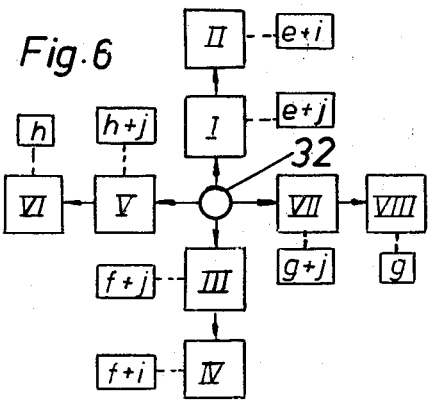
Figure 7:
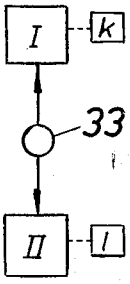

In FIGS. 5, 6 and 7, the moving pattern of the operating means 31, 32 and 33 mounted on the operator's panel is shown diagrammatically. The operating means 31, which is a control lever of the combination type, is intended to control the movements of the boom 10. In the shown embodiment, the operating means 31 is movable in two steps in each of the four indicated directions. In the positions I and II the boom is lowered, in the positions III and IV it is elevated, in the positions V and VI it is swung leftwards and in the positions VII and VIII it is swung rightwards. With the control means in the positions I, III, V or VII the boom moves at a lower speed in the respective directions than with the operating means in the positions II, IV, VI or VIII.

In the hydraulic coupling circuitry shown in FIG. 3 the valves 22–27 are controlled by electromagnets. With the operating means 31–33 in any of the positions I–VIII contacts are closed, whereby the magnets of the valves are actuated in the way shown diagrammatically in FIGS. 5, 6 and 7. In a preferred embodiment of the invention, with the operating means 31 in position I, the valves 22 and 27 are adjusted via the coils of the magnets *a* and *j* in such a way that pressure fluid is supplied to the upper chamber of the cylinder 12 and the return flow from the lower chamber is caused to pass through the restriction 28. If the operating means 31 is moved to position II the adjustment of the valve 22 is maintained by the coil of the magnet *a* but the valve 27 is adjusted via the coil of the magnet *i* in such a way that the return flow is caused to pass through the restriction 29 provided with the larger area. The speed by which the boom 10 is moved is thereby increased stepwise. With the operating means 31 in the positions V, VI and VII, VIII respectively the swinging speed of the boom is altered in the same way stepwise by adjustment of the valves 23 and 27 via respectively the coils *c*, *d* and *i*, *j*. In the preferred embodiment, the step between the different speeds upwards of the boom has been made greater by the fact that the operating means 31 in position III adjusts the valve 27 via the coil *j* for conducting the return flow through the restriction 28 provided with the smaller area while the operating means 31 in position IV leaves the valve 27 unactuated for conducting the return flow directly to the tank 30.

The tilting and swinging speed of the feed bar 11 can in the same way be adjusted stepwise by means of the operating means 32. In a preferred embodiment, however, the greatest swinging speed of the feed bar has been increased by leaving the valve 27 unactuated when the operating means 32 are in the positions VI and VIII. With the valve 27 unactuated, the return flow from the cylinder 15 is conducted via a by-pass line directly to the tank 30, as may be seen in FIG. 3. The displacement of the feed bar 11, for which there is no need of adjusting the speed, is controlled by the operating means 33 which adjusts the valve 24 via the coils *k*, *l*. The return flow from the cylinder 14 is conducted directly to the tank 30.

With the speed control of a piston carried out according to the invention there is attained improved inching characteristics, small operating forces, no main valves placed in direct connection to the operator's panel, the possibility of controlling the piston from several places and a feeling of a continuous speed control by the stepwise movement of the operating means.

The embodiment shown by way of example is only illustrative of the invention and various modifications thereof may be made. For example, the number of steps for the speed of the pistons as well as the size of the steps can be varied in a suitable manner according to circumstances. The type of valve and operating means can be chosen arbitrarily. The valves can, besides electrically, also be controlled pneumatically or hydraulically. The invention may of course be used for controlling the movements of any hydraulic motor, such as rotary motors.

What I claim is:

1. In a method of controlling the speed of the movements of a working implement, said working implement being movable three-dimensionally in space by hydraulic motors and carried by a hydraulic boom, said hydraulic boom being pivotally arranged with respect to a support, and a hydraulic circuit being provided for said hydraulic motors for providing a return flow from said hydraulic motors to low pressure, the improvement comprising:

selectively ramifying the return flow manually into one of at least two return flow branches, and providing flow restriction in at least said one of said branches for decreasing the speed of movement of the working implement in a step of a predetermined amount which is a function of the size of the restriction so as to obtain an accurate inching.

2. A method according to claim 1, comprising joining the return flow from at least two motors before the branching thereof.

3. A method according to claim 2, in which the working implement is pivotally mounted to the hydraulic boom and comprising pivoting said implement relative to the hydraulic boom by one of said at least two motors.

4. In a method of controlling the speed of the movements of an elongated rock drilling apparatus, said elongated rock drilling apparatus being movable three-dimensionally in space by hydraulic motors and carried by a hydraulic boom, said hydraulic boom being pivotally arranged with respect to a support, said hydraulic motors each comprising a double-acting piston movable to and fro within a cylinder chamber under the influence of hydraulic fluid respectively supplied to and returned from the opposite ends of said cylinder chamber, and the return flow from said cylinder ends being conducted to a tank, the improvement comprising:

alternatively ramifying the return flow manually into one of at least two branches, and providing flow restriction in at least said one branch for decreasing the speed of said elongated rock drilling apparatus in a step of predetermined amount which is a function of the size of the restriction so as to obtain an accurate inching.

5. In a method of controlling the speed of the movements of a feed bar carrying a rock drilling machine mechanically fed therealong, of the type wherein the feed bar is movably supported on the outer end of a drill boom, the drill boom is movably carried on a drill rig, and the movements of the feed bar and the drill boom respectively are performed by double-acting pistons, each piston being movable to and fro within a cylinder chamber under the influence of hydraulic fluid respectively supplied to and returned from the opposite ends of said cylinder chamber, and the return flow from said cylinder being conducted to a tank, the improvement comprising:

selectively ramifying the return flow manually into one of at least two return flow branches, providing flow restriction in said one of said branches for decreasing the speed of the feed bar in a step of predetermined amount so as to obtain an accurate inching, and joining the return flow from at least two cylinders before the branching of the return flow.

6. In a hydraulic boom arrangement comprising a boom pivotally arranged with respect to a support, means on said boom for carrying a working implement for three-dimensional movement of said working implement in space, at least one hydraulic motor connected to said boom for swinging the boom relative to the support, a pressure fluid source, means for supplying pressure fluid to said motors, a tank, and means for conducting the return fluid flow from said at least one motor to the tank via a conduit, the improvement comprising:

a valve connected in said conduit, at least two branches of said conduit between said valve and said tank, fluid restriction means connected in at least one of said at least two branches, and manually operated means coupled to said valve to set said valve for selectively conducting the return fluid flow from said at least one motor through said restriction means for decreasing the speed of the working implement in a predetermined amount which is a function of the size of the restriction so as to obtain an accurate inching.

7. In a hydraulic boom arrangement comprising a boom (10) pivotally mounted on a support, means on said boom for carrying a working implement, at least one hydraulic cylinder (12) pivotally attached to said boom and to said support respectively for swinging the boom relative to the support, a pressure fluid source (21), a feed conduit coupling said fluid source to each of said at least one hydraulic cylinder, a valve means (22) in each feed conduit, a control circuit operatively coupled to said valve means, operating means (31) coupled to said control circuit for setting said valve means via said control circuit for conducting pressure fluid to said at least one cylinder from said source via said feed conduit, a tank (30), and a return conduit for conducting the return fluid flow from said at least one cylinder to said tank (30), the improvement comprising:

a second valve means (27) connected in said return conduit and being operatively coupled to said control circuit, at least two branches of said return conduit between said second valve means (27) and said tank (30), and a first fluid restriction means (28) connected in at least one of said branches, said operating means (31) including means for selectively setting said second valve means via said control circuit for selectively conducting said return fluid flow through either one of said at least two branches.

8. A boom arrangement according to claim 7, wherein said working implement is pivotally connected to the boom (10), and further comprising:

at least a further hydraulic cylinder means (16) connected to said boom and to said working implement, a further feed conduit coupling said fluid source to said further cylinder means (16), a third valve means (26) in said further feed conduit and being operatively coupled to said control circuit, second operating means (32) for selectively setting said third valve means (26) via said control circuit for conducting pressure fluid to said further cylinder means (16), and a return conduit for conducting the return flow from said further cylinder means (16) to said tank (30), said return conduit of said further cylinder means being connected to said second valve for selectively conducting the return fluid flow through at least either one of said at least two branches.

9. A boom arrangement according to claim 8, wherein said working implement is a rock drilling apparatus.

10. A boom arrangment according to claim 7, wherein said operating means (31) is adjustable stepwise to at least a first (I) and a second (II) position respectively and sets said valve (22) when in said first position.

11. A boom arrangement according to claim 10, wherein said first fluid restriction means (28) includes a first restriction valve (28) and said operating means (31) in said first position (I) sets said second valve (27) for conducting the return fluid flow through said first restrictor valve (28).

12. A boom arrangement according to claim 10, comprising a second restrictor valve (29) in the other of said branches, and wherein said operating means (31) in said second position maintains the setting of said valve (22) and sets said second valve (27) for conducting the return flow through said second restrictor valve (29), said second restrictor valve (29) having a larger area than said first restrictor valve (28).

13. A boom arrangement according to claim 11, comprising a by-pass line from said second valve (27) to said tank, and wherein said operating means (31) in said second position maintains the setting of said valve (22) and sets said second valve (27) via said control circuit for conducting the return fluid flow via said by-pass line to tank.

14. A boom arrangement according to claim 7 comprising a second fluid restriction means (29) connected in the other of said at least two branches, the first fluid restriction means providing a greater restriction to fluid flow than said second fluid restriction means.

15. A boom arrangement according to claim 7 further comprising a by-pass line coupled from said second valve (27) to said tank for selectively by-passing the return fluid flow to said tank without passing through either of said at least two branches.

* * * * *